US006752748B1

(12) United States Patent
Scotti

(10) Patent No.: US 6,752,748 B1
(45) Date of Patent: Jun. 22, 2004

(54) ABDOMINAL EXERCISER

(75) Inventor: Phil Scotti, Jamul, CA (US)

(73) Assignee: Body by Jake Enterprises, Los Angeles, CA (US)

( * ) Notice: Subject to any disclaimer, the term of this patent is extended or adjusted under 35 U.S.C. 154(b) by 0 days.

(21) Appl. No.: 10/417,232

(22) Filed: Apr. 17, 2003

(51) Int. Cl.[7] ..... A63B 21/068; A63B 23/02
(52) U.S. Cl. ..... 482/140; 482/96
(58) Field of Search ..... 482/72, 95, 96, 482/131, 137, 140, 142

(56) References Cited

U.S. PATENT DOCUMENTS 5,616,106 A * 4/1997 Abelbeck ..... 482/96
5,665,041 A * 9/1997 Hsieh ..... 482/140
5,669,865 A * 9/1997 Gordon ..... 482/142
5,674,161 A * 10/1997 Lin ..... 482/96
5,676,626 A * 10/1997 Huang ..... 482/96
5,690,593 A * 11/1997 Huang ..... 482/96
5,702,334 A * 12/1997 Lee ..... 482/140
5,711,749 A * 1/1998 Miller ..... 482/135
5,716,308 A * 2/1998 Lee ..... 482/130
5,722,918 A * 3/1998 Lee ..... 482/72
5,769,766 A * 6/1998 Huang ..... 482/140
6,168,557 B1 * 1/2001 Liao ..... 482/140
6,206,809 B1 * 3/2001 Habing et al. ..... 482/96

* cited by examiner

*Primary Examiner*—Nicholas D. Lucchesi
*Assistant Examiner*—Victor Hwang
(74) *Attorney, Agent, or Firm*—Fei-Fei Chao; Venable LLP

(57) ABSTRACT

An abdominal exerciser has a base (10), a pulling frame (20), seat assembly (30), a step device (40) and multiple actuating linkages. The pulling frame (20), the seat assembly (30) and the step device (40) are pivotally connected to the base (10) and to each other by the multiple actuating linkages. Thereby, the abdominal the step device (40) and the seat assembly (30) are pivoted toward the pulling frame (20) by the actuating linkage when the pulling frame (20) is pulled down to cause a person to bend to exercise and tone the abdominal muscles.

13 Claims, 4 Drawing Sheets

ABDOMINAL EXERCISER

BACKGROUND OF THE INVENTION

1. Field of the Invention

The present invention relates to an abdominal exerciser, and more particularly to an abdominal exerciser on which a user seats to perform a bending movement and efficiently tone the muscle of abdomen.

2. Description of Related Art

People in modern times pay much attention to their health and to keeping their bodies in good shape. Therefore, various indoor exercisers have been invented, produced and sold in the market. General exercisers such as treadmill, exercise bikes and steppers are available so a person can tone his or her body, and each kind exerciser is used to exercise and train a specific part of the body.

Even though various types of exercisers have been invented, an exerciser for training abdominal muscles is rare. People usually do sit-ups on a flat surface without any auxiliary equipment or use an inclined bench to make the sit-ups more strenuous than simply doing sit-ups on a flat surface.

The auxiliary equipment for sit-ups is basically the previously mentioned inclined bench mounted on a base. People lie on the bench with their legs elevated to perform the sit-ups, and the inclined angle of the bench increase the difficulty of the sit-ups exercise. Although the training efficiency of the sit-up exercise is increased significantly, performing sit-ups on an inclined bench is often too difficult for a beginner. Additionally, when practices the sit-up exercise, users have to stick their feet and only push upper body above the waist close to the feet that causes overload to the spine (especially at the neck) and easily causes injury when sitting up from a prone position to a sitting position.

The present invention has arisen to mitigate or obviate the disadvantages of the conventional fitting exerciser of inclined bench.

SUMMARY OF THE INVENTION

The main objective of the present invention is to provide a novel abdominal exerciser that is operated in a bending movement to efficiently train muscle of the abdomen.

Further benefits and advantages of the present invention will become apparent after a careful reading of the detailed description with appropriate reference to the accompanying drawings.

DETAILED DESCRIPTION OF THE PREFERRED EMBODIMENT

Figure 1:
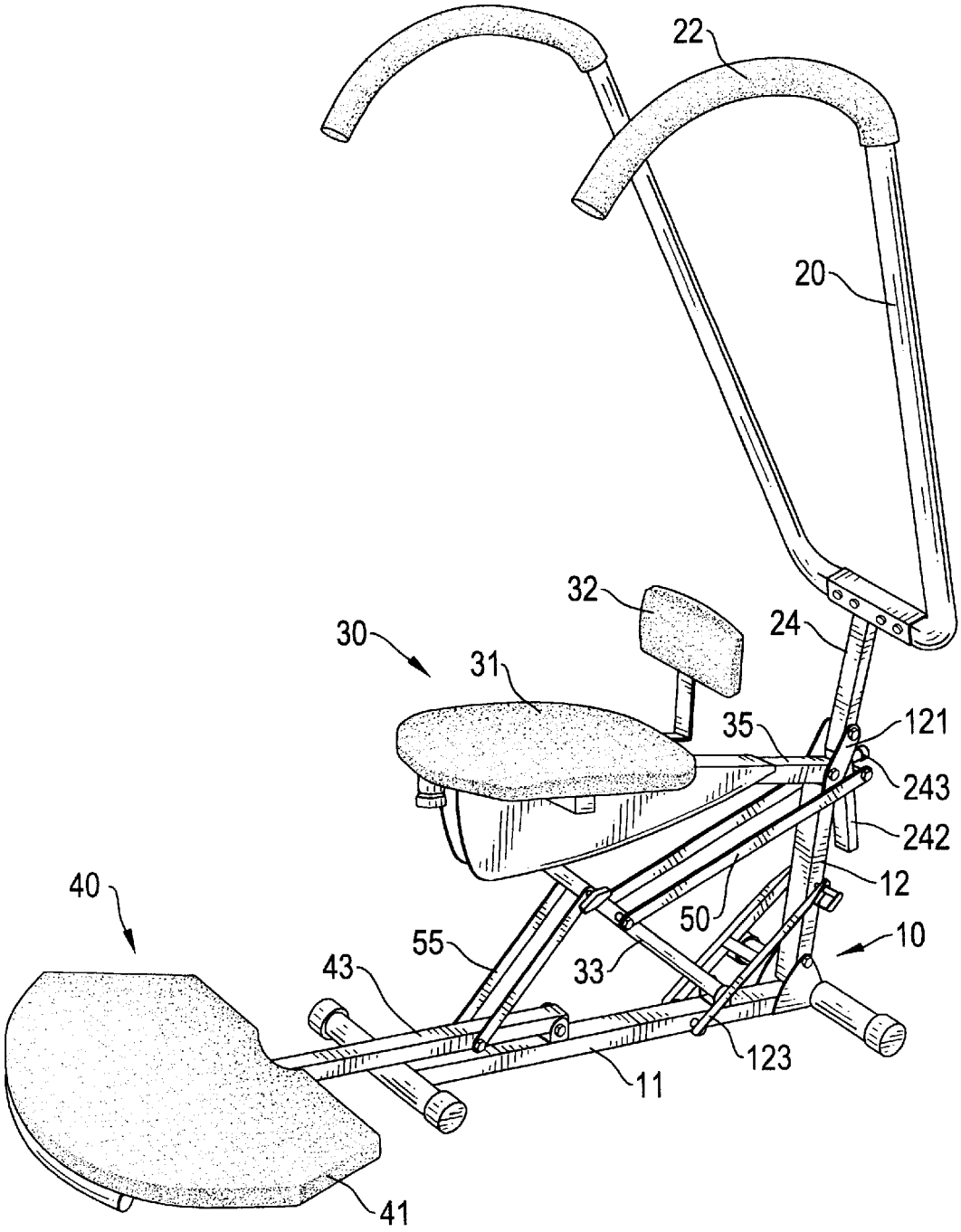
FIG. 1 is a perspective view of an abdominal exerciser in accordance with the present invention.
Figure 2:
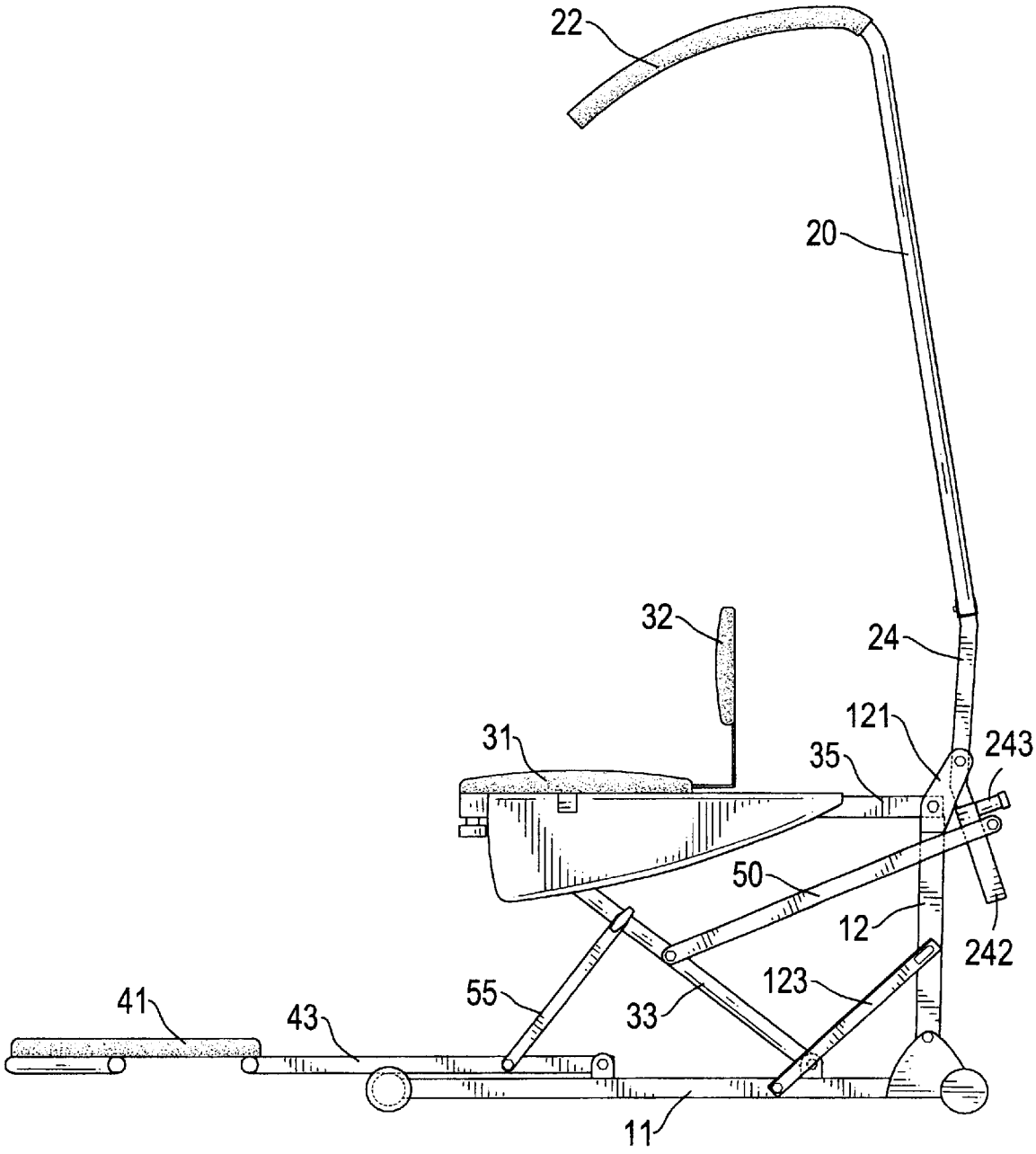
FIG. 2 is a side plane view of the abdominal exerciser 1, wherein the abdominal exerciser is extended.

With reference to FIGS. 1 and 2, an abdominal exerciser in accordance with the present invention comprises a base (10), a pulling frame (20), a seat assembly (30), a step device (40) and an actuating linkage (not numbered).

The base (10) with a front and a rear comprises an I-shaped frame (11) and a post (12). The I-shaped frame (11) is composed of a longitudinal rod (not numbered) and two transverse legs (not numbered). The longitudinal rod has a front end (not numbered) and a rear end (not numbered). The transverse legs (not numbered) are connected respectively across the front end and the rear end of the longitudinal rod so the base (10) is stable on a flat surface such as a floor. The post (12) has a proximal end (not numbered), a distal end (not numbered), a rigid H-frame stay (123) and a U-shaped bracket (121). The H-frame stay (123) has an upper end (not numbered) and a lower end (not numbered). The proximal end of the post (12) is pivotally or immovably attached to the rear end of the longitudinal rod. The upper end of the rigid H-frame stay (123) is detachably connected to the post (12), and the lower end is pivotally connected to the longitudinal rod to hold the post (12) in a vertical position. The U-shaped bracket (121) is formed on the distal end of the post (12).

The pulling frame (20) is pivotally attached to the post (12) and is composed of a U-shaped handlebar (not numbered) and a pivoting rod (24). The U-shaped handlebar has two distal ends (not numbered), a middle portion (not numbered) and two curved handles (22). The curved handles (22) are formed respectively at the distal ends of the U-shaped handlebar. The pivoting rod (24) has a proximal end (not numbered), a distal end (not numbered), a midpoint (not numbered) and a lower segment (242). The proximal end of the pivoting rod (24) is attached to the middle portion of the U-shaped handlebar and extends away from the U-shaped handlebar at an obtuse angle (not numbered). The midpoint of the pivot rod (24) is pivotally mounted in the U-shaped bracket (121) and the lower segment (242) extends outward below the U-shaped bracket (121). Additionally, a stop (243) protrudes out of the lower segment (242).

The seat assembly (30) comprises a seat (31), a seat beam (35), a seat post (33) and optionally a backrest (32) and is pivotally attached to the longitudinal rod and the post (12) of the base (10). The seat (31) has a bottom (not shown), and the seat post (33) has an upper end (not shown) and a lower end (not numbered). The upper end of the seat post (33) is slidably and pivotally attached to the bottom of the seat (31), and the lower end is pivotally attached to the longitudinal rod of the base (10) near the rear end of the I-shaped frame. The seat beam (35) extends from the bottom of the seat (31) and is pivotally attached to the U-shaped bracket (121) to enhance the stability of the seat assembly (30). The backrest (32) may be attached to the seat (31) at the back.

The step device (40) comprises a foot plate (41) and a step rod (43). The step rod (43) has a proximal end (not shown) and a distal end (not numbered). The distal end of step rod (43) is securely attached to the foot plate (41), and the proximal end is pivotally attached to the longitudinal rod of the base (10) near the front end of the I-shaped frame.

The actuating linkage comprises a pair of seat linkage rods (50) and a pair of step linkage rods (55). The seat linkage rods (50) and step linkage rods (55) are pivotally connected between the pulling frame (20), the seat assembly (30) and the step device (40) so movement of one element will cause a corresponding movement in the other elements. Each seat linkage rod (50) has a front end (not numbered) and a rear end (not numbered). The front ends of the seat linkage rods (50) are pivotally attached to the seat post (33), and the rear ends are detachably hooked on the lower segment (242) of the pivot rod (24) of the pulling frame (20). The rear ends of the seat linkage rods abut against to the stop (243) to limit the rear ends slide upward when the handles of pulling frame (20) are pulled downward. Each step linkage rod (55) has a front end (not numbered) and a rear end (not numbered). The front ends of the step linkage rods (55) are pivotally attached to the step rod (43) of the step device (40), and the rear ends are detachably and pivotally attached to the seat post (33) of the seat assembly (30) by a screw (not numbered). Thereby, the seat linkage rods (50) and the step linkage rods (55) cause the pulling frame (20), the seat assembly (30) and the step device (40) to move simultaneously.

Figure 3:
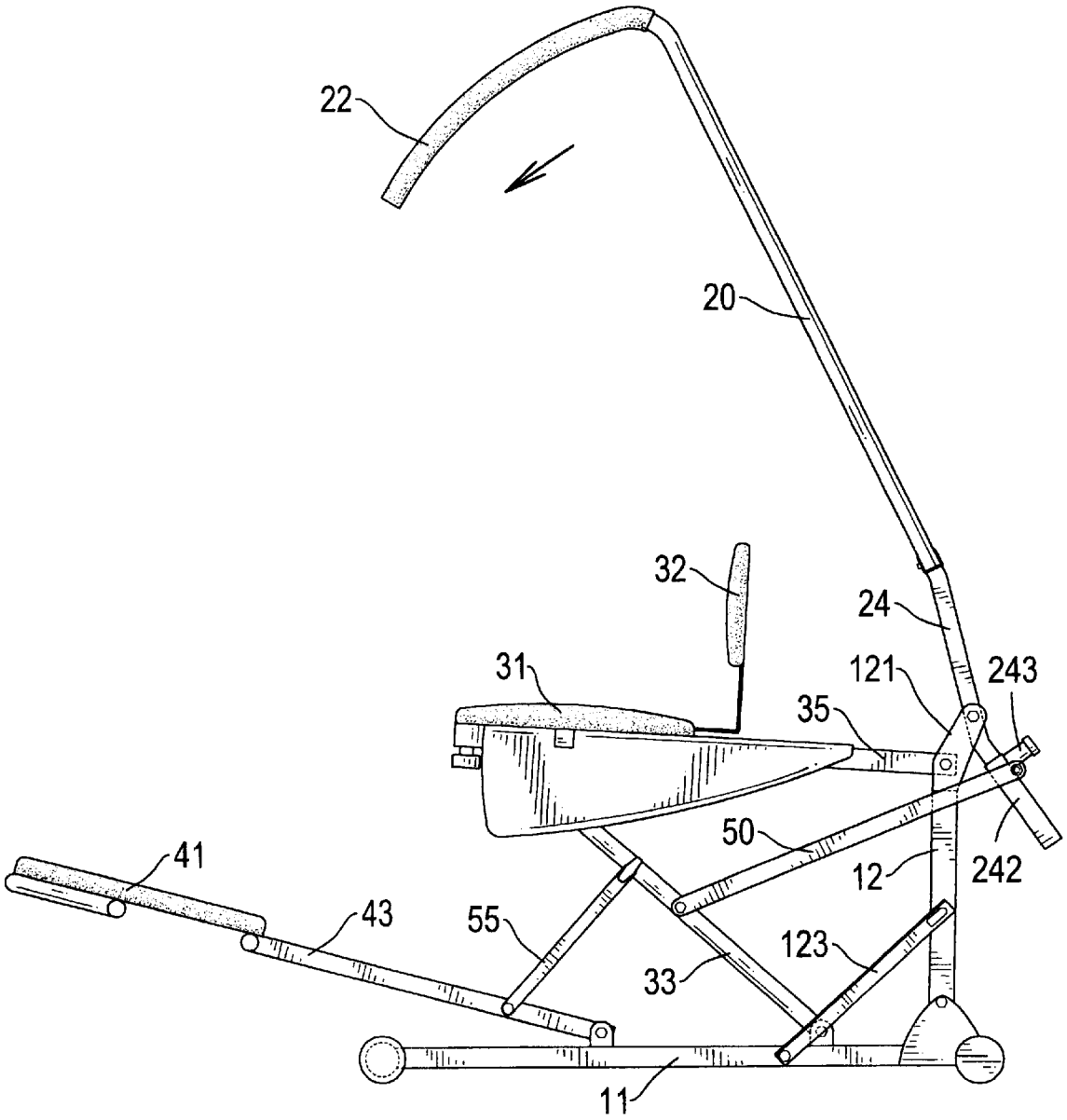
FIG. 3 is a side plane view of the abdominal exerciser in FIG. 1, wherein the abdominal exerciser is bended.

With further reference to FIG. 3, when the abdominal exerciser is operated, a user has to sit on the seat (31) of the seat assembly (30). First, a user grips the handles (22) of the pulling frame (20) and bends at the abdomen to pull the pulling frame (20) down. Thereby, the lower segment of the pivot rod (24) levers up and pulls the seat linkage rods (50) that pivots the seat post (33) with the seat assembly (30) toward the pulling frame (20). Movement of the seat post (33) pulls the step linkage rods (50) that pivots the step rod (43) and the step device (40) upward. Therefore, the step device (40) simultaneously moves toward the pulling frame (20) with the seat assembly (30). After pulling the handles (22) down as far as possible, the user pushes down the raised step device (40) and allows the handles (22) to move upward in preparation for the next bending sequence. Repetition of these actions exercise and tone the abdominal muscles efficiently.

Figure 4:
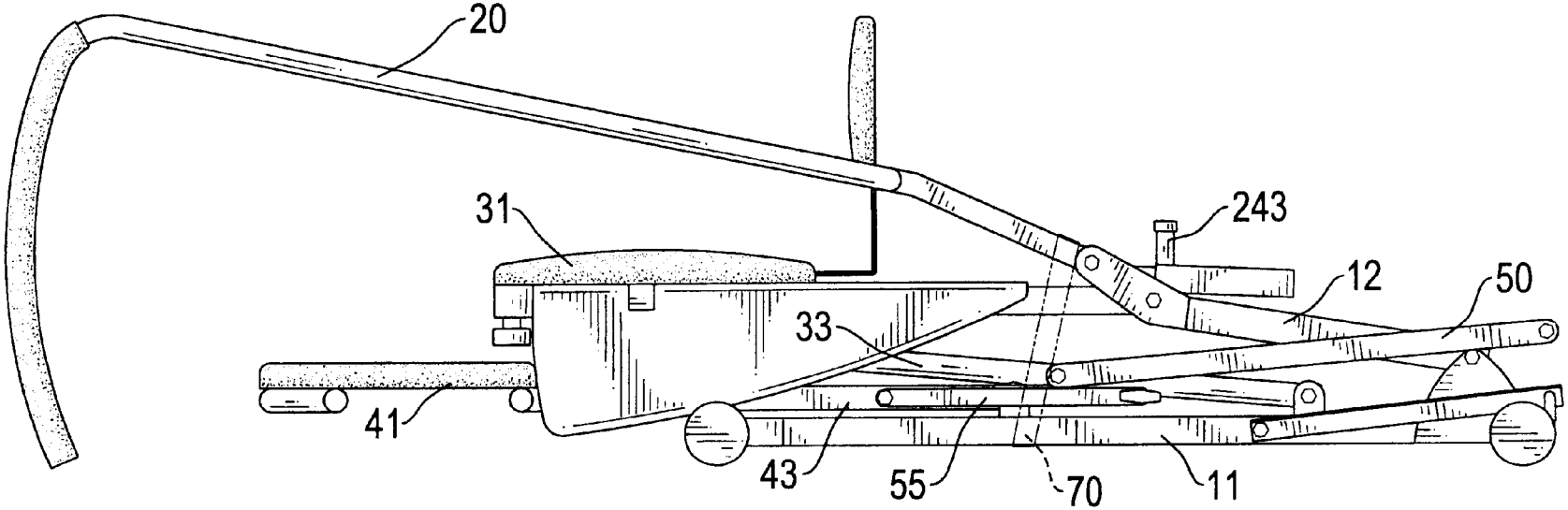
FIG. 4 is a side plane view of the abdominal exerciser in FIG. 1, wherein the abdominal exerciser is folded and fasten by a resilient strip.

With reference to FIG. 4, the abdominal exerciser is completely collapsible so it occupies very little space when not in use. Since the seat linkage rods (50) only hook on the lower segment (242) of the pivot rod (24) of the pulling frame (20) and the step linkage rods (55) are detachably connected to the seat post (33), the seat linkage rods (50) and the step linkage rods (55) can be detached from the pulling frame (20) and the seat post (33) to completely fold the pulling frame (20), the seat assembly (30) and the step device (40) together. After folding the abdominal exerciser completely, a fastener, such as a resilient strap (70), is used to hold the abdominal exerciser in the folded condition. Additionally, a pair of wheels (not shown) is attached on the rear end of the I-shaped frame of the base (10) so that the folded abdominal exerciser can be lifted up by pulling the handles (22) and pushed conveniently to move the abdominal exerciser.

Since a person is sitting to exercise the abdominal muscles when the abdominal exerciser is operated, the person does not have to lift the upper body from a prone position to a sitting position and will not unduly stress the spine. Furthermore, the step device (40) moves in harmony with the pulling frame (20) to reduce stress on the upper body. For a beginner, the abdominal exerciser provides an easy and safe training way to exercise and tone the abdominal muscles and keep the body fit.

Although the invention has been explained in relation to its preferred embodiment, it is to be understood that many other possible modifications and variations can be made without departing from the spirit and scope of the invention as hereinafter claimed.

What is claimed is:

1. An abdominal exerciser comprising:

a base (10) with a front and a rear, and having a post (12) erected on the rear of the base (10);

a pulling frame (20) pivotally mounted on the post (12) and having a U-shaped handlebar with two distal ends and a middle portion, two curved handles (22) formed at the two distal ends respectively and a pivoting rod (24) extending from the middle portion of the U-shaped handlebar, wherein the pivot rod (24) is pivotally attached to the post (12) and remains a lower segment (242) extending outward;

a seat assembly (30) pivotally mounted on the base (10) and having a seat (31) with a bottom, a seat post (33) with two ends and a seat beam (35) attached on the seat (31) and extending to pivotally secure on the post (12), wherein the seat post (33) is pivotally and slidably attached on the bottom of the seat (31) at one end and pivotally secures on the base (10) at the other end;

a step device (40) pivotally mounted on the front of the base (10) and having a foot plate (41) and a step rod (43) with two ends, wherein the step rod (43) secures on the foot plate (41) at one end and pivotally mounts on the rear end of the base (10) at the other end;

at least one seat linkage rod (50) pivotally secured the seat post (33) of the seat assembly (30) at one end and detachably engaging on the lower segment (242) of the of the pulling frame (20) at the other end; and at least one step linkage rod (55) pivotally secure between the step rod (43) of the step device (40) and the seat post (33) of the seat assembly (30).

2. The abdominal exerciser as claimed in claim 1, wherein the base comprises an I-shaped frame (11) composed of a longitudinal rod with a front and rear ends and two transversal legs connect the two ends of the longitudinal rod; and wherein the post (12) erects on the front end of the longitudinal rod.

3. The abdominal exerciser as claimed in claim 2, wherein the post (12) further has a distal end and a U-shaped bracket (121) formed on the distal end of the post (12) to pivotally engage with the pivot rod (24) of the pulling frame (20).

4. The abdominal exerciser as claimed in claim 3, wherein the pulling frame (20) further has a stop (243) formed on the lower segment (242) to stop the movement of the seat linkage rod (50).

5. The abdominal exerciser as claimed in claim 4, in which a screw is detachably secured on a conjunction of the seat post (33) and the step linkage rods (55).

6. The abdominal exerciser as claimed in claim 5, wherein the post (12) is pivotally mounted on the rear end of the I-shaped frame of the base (10); and in which at least one rigid H-frame stay (123) is secured between the post (12) and longitudinal rod of the base (10).

7. The abdominal exerciser as claimed in claim 6, wherein the seat assembly further has a backrest (32) secured behind the seat (31).

8. The abdominal exerciser as claimed in claim 3, in which a screw is detachably secured on a conjunction of the seat post (33) and the step linkage rods (55).

9. The abdominal exerciser as claimed in claim 2, wherein the pulling frame (20) further has a stop (243) formed on the lower segment (242) to stop the movement of the seat linkage rod (50).

10. The abdominal exerciser as claimed in claim 2, in which a screw is detachably secured on a conjunction of the seat post (33) and the step linkage rods (55).

11. The abdominal exerciser as claimed in claim 1, wherein the post (12) further has a distal end and a U-shaped bracket (121) formed on the distal end of the post (12) to pivotally engage with the pivot rod (24) of the pulling frame (20).

12. The abdominal exerciser as claimed in claim 1, wherein the pulling frame (20) further has a stop (243) formed on the lower segment (242) to stop the movement of the seat linkage rod (50).

13. The abdominal exerciser as claimed in claim 1, in which a screw is detachably secured on a conjunction of the seat post (33) and the step linkage rods (55).

* * * * *